US005419103A

United States Patent [19]

Edwards

[11] Patent Number: 5,419,103

[45] Date of Patent: May 30, 1995

[54] ANIMAL PACK FRAME

[75] Inventor: Vanessa G. Edwards, St. Maries, Id.

[73] Assignee: North Idaho Packs, St. Maries, Id.

[21] Appl. No.: 212,366

[22] Filed: Mar. 14, 1994

[51] Int. Cl.[6] ..... B68C 1/00

[52] U.S. Cl. ..... 54/37.1

[58] Field of Search ..... 54/37.1, 40.1; 224/905

[56] References Cited

U.S. PATENT DOCUMENTS

| | | | |
|---|---|---|---|
| 413,501 | 10/1889 | Egger | 224/199 |
| 501,821 | 7/1893 | Browne . | |
| 618,329 | 1/1899 | Calvert | 54/37.1 |
| 652,587 | 6/1900 | Bliss | 54/37.1 |
| 806,781 | 5/1905 | Daly | 54/37.1 |
| 1,175,731 | 3/1916 | Enyeart . | |
| 1,239,756 | 9/1917 | Bader et al. . | |
| 5,267,428 | 12/1993 | Mayo | 54/37.1 |

*Primary Examiner*—Robert P. Swiatek
*Attorney, Agent, or Firm*—Wells, St. John, Roberts, Gregory & Matkin

[57] ABSTRACT

A pack frame for a pack animal such as a mule includes a pair of base frames, each including an upright frame member extending between top and bottom ends. Straps are provided at top ends of the upright frame members to connect the base frames to a conventional pack saddle on the pack animal. Arched surfaces, provided on each upright frame member, extend between the top and bottom ends of the upright frame members. The surfaces are shaped to conform to the pack animal's rib cage. A support arm frame is mounted to each of the base frames by integral hinges. The hinges are oriented upwardly of stop surfaces that are also integral with the upright frame members and the support arm frame. The hinges are spaced outwardly of the arched surfaces, between each support arm frame and base frame to permit either of the support arm frames to move between: (a) a self supported operative position substantially normal to the adjacent upright frame member, and (b) an inoperative position substantially parallel to the adjacent upright frame member. The stop surfaces prevent the support arm frame from pivoting beyond the self supported operative position and are situated directly below the hinges.

20 Claims, 4 Drawing Sheets

ANIMAL PACK FRAME

TECHNICAL FIELD

The present invention relates to frames mountable to an animal for carrying cargo, and more particularly to a foldable frame that is mountable to a conventional pack saddle.

BACKGROUND OF THE INVENTION

Pack animals such as pack horses, mules, donkeys, and others support cargo on pack "saddles" designed specifically to enable mounting and balancing of the cargo on the animal. The cargo is typically secured to the pack saddle by pack lines that lash the cargo to the pack frame in a tight, balanced load.

Possibly the most used form of pack saddle, at least for horses, mules and donkeys, is the "Decker" saddle. This form of pack saddle is a simple construction, including a pliable pad "half breed" and cover that is mounted by appropriate straps to the animal's back. A pair of "D" rings project upwardly from the saddle directly over the animal's spine. The rings are used as a tie-off base for the pack lines to secure the cargo to the saddle and pack animal.

Tying and balancing cargo on a pack animal is nearly an art form, requiring long experience and training to do properly. One problem is holding the cargo in place while the pack lines are lashed to the saddle, and positioning the pack lines so the cargo will not shift and eventually fall from the pack.

As a solution, rigid self-contained canisters have been provided that can be attached by straps to pack saddle "D" rings. While this solution is serviceable for some cargo, the space provided within the canisters is limited and will not work at all for some loads-fence posts being one example.

Another solution is provided by manufacturers of large canvas or leather "saddle bag" packs that also function to hold cargo. These packs are connected together by a web which fits over the animal's back and does not require a pack saddle for attachment. However, saddle bag type carriers also suffer similar cargo size and shape limitations as the rigid canisters mentioned above.

A shelf mounted to a pack saddle was designed and used experimentally by the present applicant. However serious drawbacks were experienced. While the rigid shelf offered stability to a wider variety of cargo, problems arose both in use and in storage due to rigid frame configuration. Also the shelf structures when not in use, present an unnecessary hazard, projecting rigidly outward from the pack animal and constantly catching on passing branches, tree trunks, etc.

U.S. Pat. No. 618,329 to Calvert offers a solution to the above problem by providing a folding "Luggage Carrier for Pack Animals". Here, a hinge was provided between vertical and horizontal carrier frame (shelf) members, allowing the shelf to fold against the vertical member when not in use. However the structure also requires the use of "brace bars" that support the shelf from the vertical member. The bars are situated at opposed ends of the shelf and therefore present an obstruction to any load that is longer than the dimension between the shelf ends. Thus much of the advantage of the folding frame is lost in the disadvantage of limited utility.

The hinges in the Calvert device are located directly adjacent the animal where weight of the cargo presses the frames into the animal's sides. The segments of the hinges are thus situated closely adjacent to the animal's hide. While in use, the hinge members can pivot slightly, pinching, pulling hairs and causing discomfort to the animal.

A need has therefor remained for a pack frame that will provide the support advantages of a shelf, without cargo length limitations, and that may be collapsed for storage on or off the pack animal without causing discomfort to the animal. The present invention fills this need, as will be fully understood below.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

Figure 1:
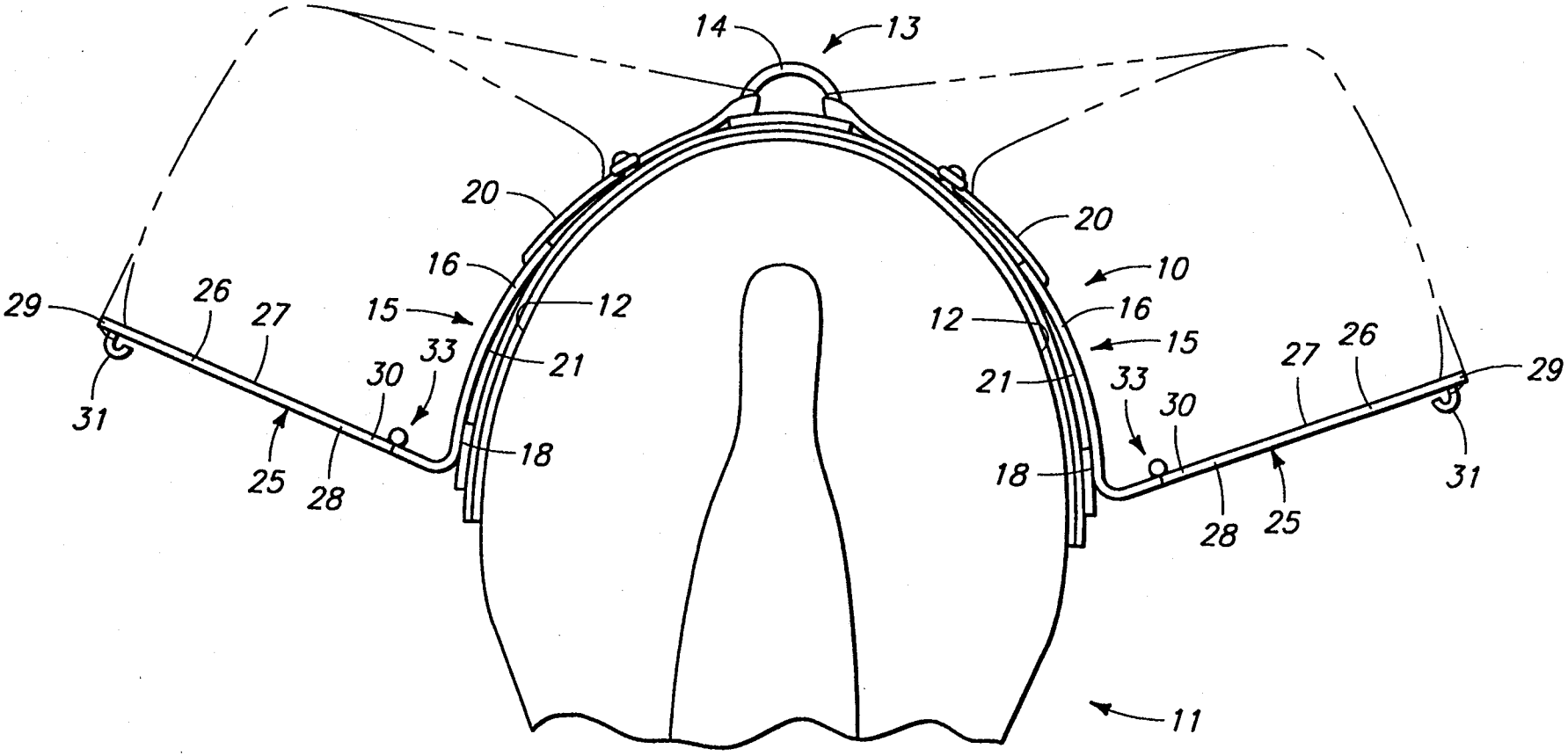
FIG. 1 is a rear elevation view of the present preferred pack frame mounted to a pack animal, cargo being shown by phantom lines.

This disclosure of the invention is submitted in furtherance of the constitutional purposes of the U.S. Patent Laws "to promote the progress of science and useful arts" (Article 1, Section 8).

It is pointed out that the preferred form of the present invention shown in the drawings is adapted especially for mounting to horses, mules, or donkeys. However the present frame can easily be modified to fit other pack animals, for example, llamas, oxen, camels, or any other four-legged animal that is suited for packing service. The frame may be easily adapted by changing the dimensions of the present pack frame to suit the particular pack animal, using substantially the same elements that will be described in greater detail below.

A preferred pack frame is exemplified in the drawings by the reference numeral 10. The frame 10, as shown in FIG. 1 is provided in pairs, with one frame subassembly on each side along the flank or rib cage 12 of the animal 11. Since the frame subassemblies are substantially mirror images of one another, description for one will serve as description for the other.

The present pack frame 10 is intended to be used in conjunction with a conventional pack saddle 13. The saddle may be of any conventional form and is not considered part of the present invention. Of the conventional pack saddles presently available, the "Decker" pack saddle is likely the most commonly used in present times, and so is exemplified in FIG. 1.

The pack saddle 13 is not discussed in detail herein, as such saddles are commonly known. However, for purposes of further description, it is pointed out that the saddle 13 includes a pair of longitudinally spaced central "D" rings, one of which is shown in FIG. 1 at 14. The other "D" ring is not visible in FIG. 1 as it is a visual element with the "D" ring shown and spaced forwardly therefrom along the pack saddle 13. The "D" rings are secured and project above the saddle pad or "half breed" and cover, or "half breed cover". The "D" rings are used for attaching the cargo (shown by phantom lines in FIG. 1). The typical "Decker" pack saddle 13 also includes pack boards along the "half breed" to spread the lateral forces of the load along the sides of the pack animal 11.

Figure 5:
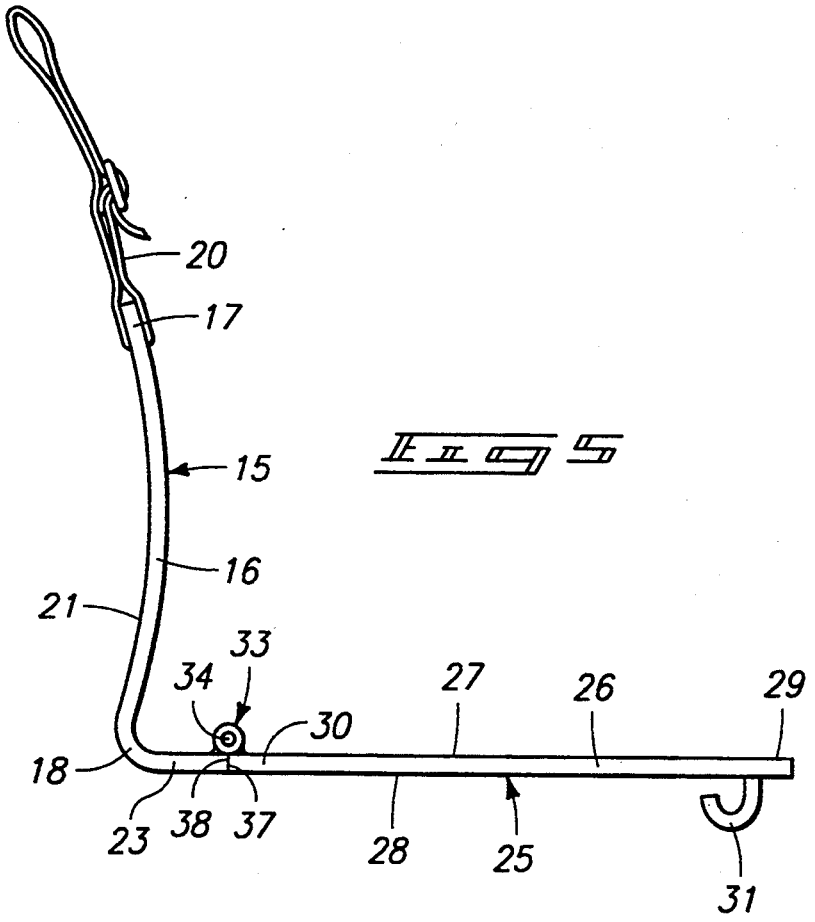
FIG. 5 is an end view with the support arm frame thereof shown in a down, operative position.
Figure 6:
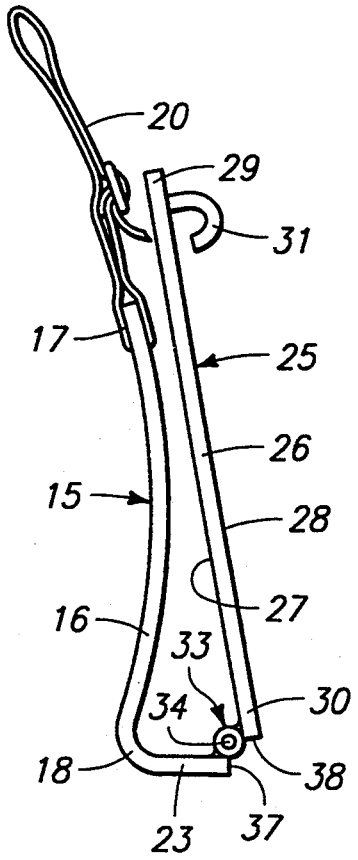
FIG. 6 is a view similar to FIG. 5 only showing the support arm frame folded to an upright operative position.

The present preferred pack frame 10 is comprised of pairs of subassemblies including base frames 15 and support arm frames 25 hinged thereon. The frames 15, 25 are connected to the pack saddle 13 by means advantageously including four substantially identical back straps 20 (FIGS. 1, 5 and 6). The straps 20 are common tack items and may or may not be provided with the pack frame 10 when purchased by the consumer. Other means, such as rigid links, bands, hooks, clasps, chains or combinations thereof (not shown) could be used to mount the pack frame subassemblies to the pack saddle 13.

It is preferable, however, that straps 20 be used, and that they be formed of leather, fabric, or plastic material of sufficient tensile strength to support, in tension, the weight of the pack frame 10 and the cargo carried thereon. Conventional buckles are provided on the strap ends to facilitate length adjustment of the straps.

One of the matching base frames 15 is shown in detail by FIGS. 2–6. The base frame 15 is advantageously formed of light but strong material such as aluminum, in an "H" configuration. It includes a pair of upright frame members 16 interconnected by a connector member 22. The upright frame members 16 and connector member 22 are rigidly secured, as by welding.

The upright frame members 16 are arched along their lengths, from top ends 17 to bottom ends 18. The arch is selected to conform to the selected pack animal, as shown in FIG. 1. Arched surfaces 21 thus engage flush against the animal sides through the pack saddle 13.

Back strap receiving slots 19 are provided in the base frames 15, one for each strap 20. The adjustable back straps 20 are received through the slots 19 to connect the two pairs of base frames 15 to the "D" rings 14 of the pack saddle 13.

Figure 2:
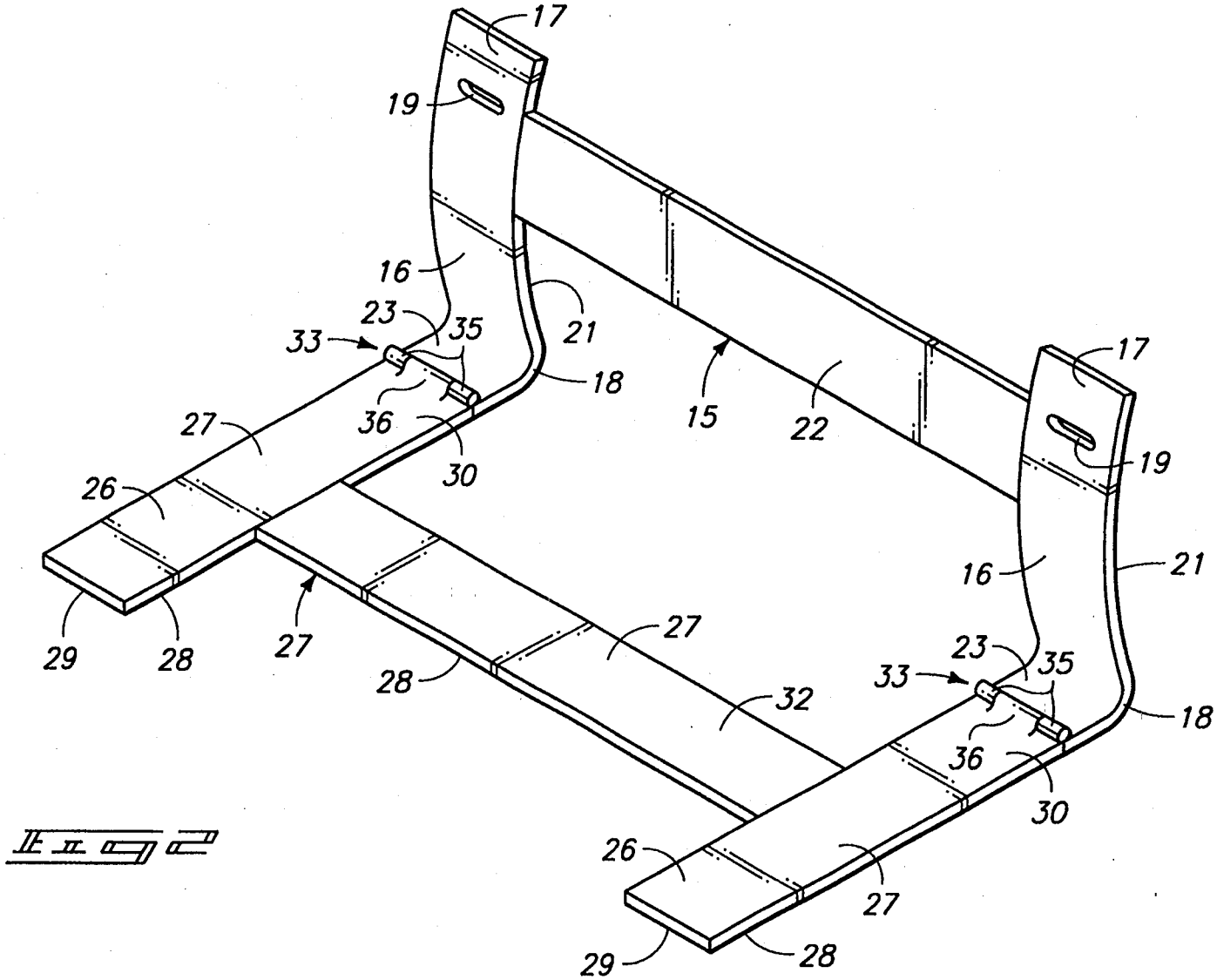
FIG. 2 is a perspective view of one side of the present pack frame, without back straps, the opposite side being a mirror image thereof.
Figure 3:
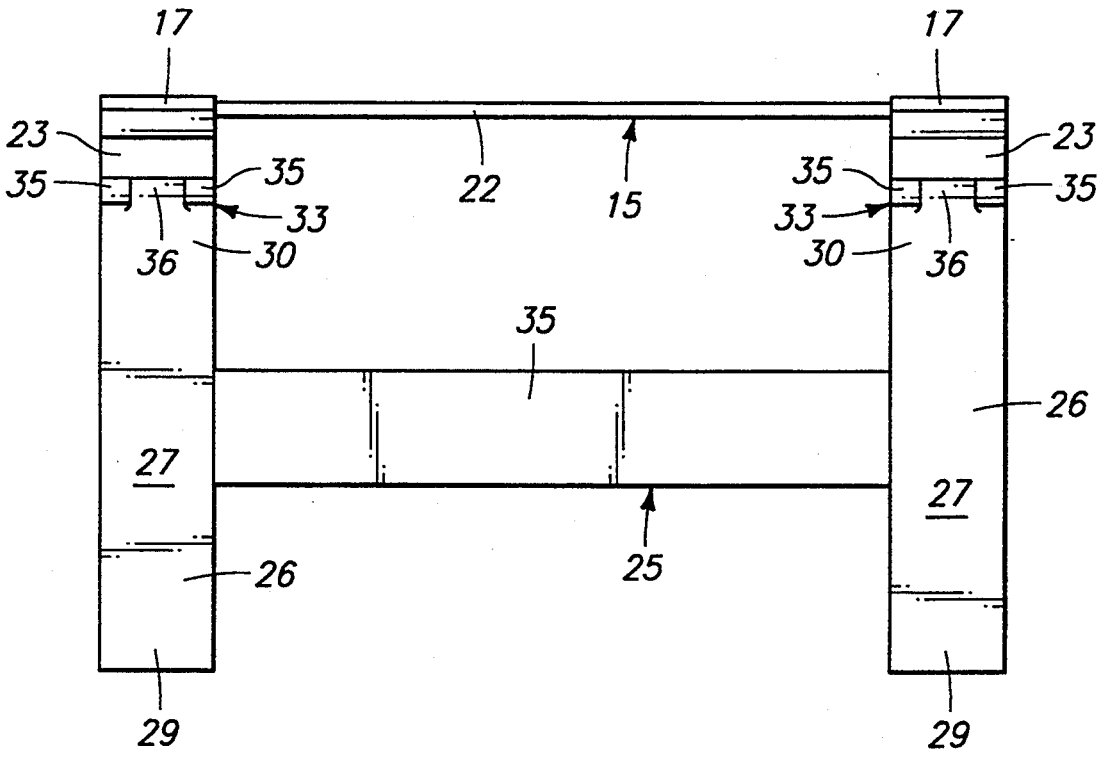
FIG. 3 is a top plan view as seen from above in FIG. 2.
Figure 4:
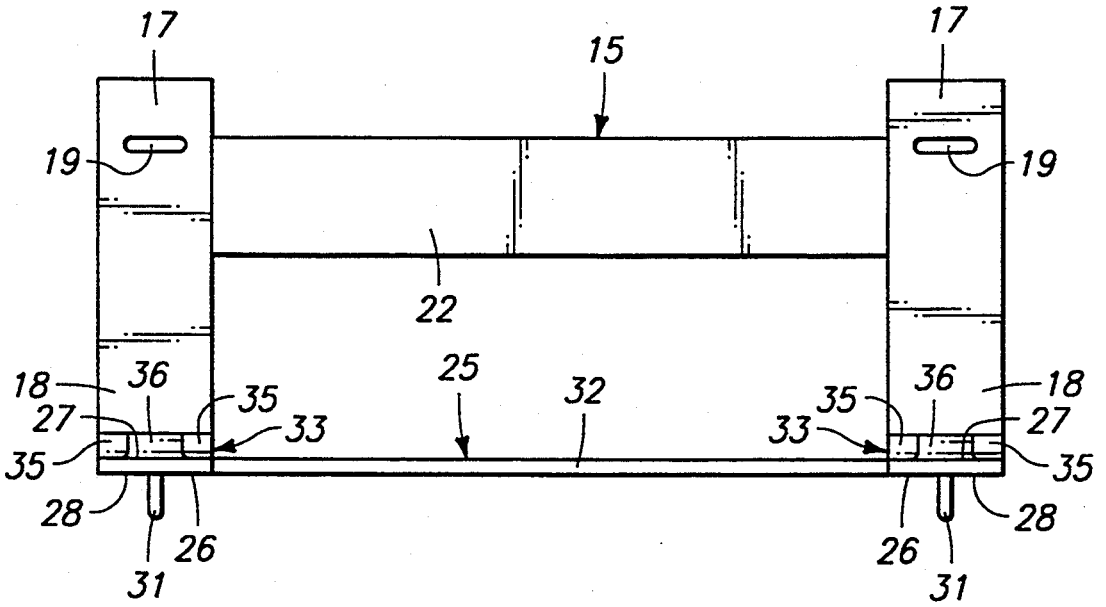
FIG. 4 is a side elevation view as seen from the left in FIG. 2.

The strap receiving slots 19 are clearly shown in FIGS. 2 and 4. They are horizontal when the pack frame is mounted to the pack animal, and are located at the top ends 17 of the upright frame members 16. The slots 19 are preferably slightly greater in length than the width dimensions of the straps 20.

The bottom ends 18 of the upright frame members 16 are bent outwardly, preferably on a radius of approximately 1 inch to avoid sharp corners that could otherwise gouge into the pack animal's sides. The bottom ends 18 include flanges 23 that extend outwardly, and are angled slightly upwardly from the horizontal. The flanges 23 extend to end stop surfaces 37. It is significant that the stop surfaces 37 are spaced outwardly away from the pack animal 11. Such spacing situates the "pinch points" of the present frame away from the pack animal. More specifically, stop surfaces 37 are advantageously situated approximately 2 inches outwardly from the upright frame members 16.

Each support arm frame 25 is formed of the same material as the base frame 15. Another "H" configuration is used for the support arm frame 25, which is comprised of a pair of support arm members 26 secured together by a connector member 32.

The support arm members 26 and connector member 32 provide top pack engaging surfaces 27 and opposed surfaces 28 which respectively face up and downwardly when the support arm frame 25 is folded down to the operative position as shown in FIGS. 1–5.

FIG. 6 shows the support arm frame 25 folded upwardly to an upright, inoperative position. In this position, the support arm frame 25 is located in close proximity to the base frame 15, thereby minimizing the overall width dimension of the pack animal when the pack frame 10 is on the pack animal but not in use.

The support arm frame 25 is advantageously flat, with the support arm members 26 extending between inward ends 30 and outward ends 29. The frame 25 is hinged at its inward support arm member ends 30 to the base frame 15.

Outward ends 29 of the support arm members 26 include pack line catches 31 situated on the opposed surfaces 28. Catches 31 are advantageously positioned on the opposed surfaces 28 to avoid being covered by the cargo.

The preferred catches 31 are provided in the form of inwardly facing hooks that may be secured to or integral with the support arm members 26. They are provided to receive and secure pack lines (shown in phantom lines in FIG. 1) that are commonly used to secure cargo to the animal and pack frame 10.

Pairs of hinges 33 mount the support arm frame 25 to the base frame 15. The hinges 33 are integral with the base frame 15 and support arm frame 25. This allows the base frame and support arm frame 25, and hinges 33 to be produced of strong, weather resistant, lightweight materials such as aluminum, while also minimizing the weight of the frames 10. The preferred hinges 33 are situated outwardly of the upright portions of the base frame, more particularly the arched surfaces thereof.

To this end, the base frame 15 includes integral first hinge sections 35 on the outwardly projecting flanges 23 of the upright base frame members 16. The support arm frame 25 includes integral second hinge sections 36 that interfit with the first hinge sections 35.

Second hinge sections 36 are integral with the support arm frame 25 and are located at the inner support arm member ends 30. Further, the second hinge sections 36 are advantageously situated on the top pack engaging surfaces 27 of the support arm frame 25.

The first hinge sections 35 are likewise positioned on the outwardly projecting flanges of the upright frame members 16 above the end stops 37. This is done in order to use the thickness of the frame members for the end stops and to position the end stops 37 and 38 so they will come together in flush abutment below the hinges when the support arm members are in the downward, operative position. The stop surfaces (FIG. 6) 37, 38 thus prevent the support arm members from moving downward past the operative position. Further, the downward facing orientation and outward spacing of the stop surfaces virtually eliminate the possibility of pinching the animal or the pack materials during mounting, loading, and use of the frame 10.

The stop surfaces 37, 38 abut (FIG. 5) to stop downward pivotal movement of the support arm frame 25 beyond the slightly upwardly inclined position as shown in FIG. 1. Stop surfaces 37, 38 otherwise allow free angular swinging movement of the support arm frame 25 between the down or operative position, and the up or inoperative position.

Hinge pins 34 (FIGS. 6, 5) pivotably join the hinge sections 35, 36. The pins 34 define coaxial hinge pin axes that are preferably horizontal when the pack frame 10 is mounted to the pack animal 11. It is also advantageous that the hinge pin axes be parallel to the top pack engaging surfaces 27 of the support arm members 26.

Operation of the invention may now be clearly understood from the description provided above, and from the appended drawings. Operation will be described assuming the pack saddle 13 has been properly mounted to the pack animal 11. Mounting procedure for the pack saddle 13 is a conventional procedure and will not be discussed further herein.

Prior to operation, the pack frame 10 is assembled simply by threading the straps 20 through the back strap receiving slots 19 in the base flames 15. Next, the ends of the front straps 20 are threaded through the front "D" ring 14 on the pack saddle 13. The rear straps 20 are threaded through the rear "D" ring. The strap ends are then secured by the conventional buckles provided thereon. This is done for both base flames 15 on opposite sides of the pack animal 11.

The loop lengths of the straps are set visually, with care taken such that base frames 15 are suspended from the straps to engage the longitudinal pack boards typically provided on the pack saddle 13. Care is also taken that the base frames 15 are at equal elevations on opposite sides of the animal substantially as shown in FIG. 1. Elevation of the subassemblies can be adjusted by changing the length of the strap loops. The preferred elevation for the base frames 15 is such that the arched surfaces 21 at the bottom frame member ends 18 will rest against the pack boards in the pack saddle 13 and conform closely to the adjacent configuration of the pack animal's anatomy (FIG. 1).

The resulting position of the support arm frames 25 is determined by the base frames 15. It is preferable that the support arm frames 25 tip slightly upward as shown in FIG. 1 when mounted to the animal. This is done so the cargo placed on the support arm frames 25 will tend to shift (if at all) toward the animal rather than off the frames.

The completed pack frame 10 is now mounted to the pack animal and is ready to be loaded with cargo. This process is greatly simplified over existing packing process steps by provision of the hinged support arm frames 25.

Further, once the present pack frame 10 is mounted to the pack saddle 13, the two may be treated as one. That is to say the pack frame 10 may remain mounted to the pack saddle 13 and be removed from the animal or mounted thereto along with the pack saddle 13.

Prior to packing, the support arm frames 25 are pivoted downwardly to their operative positions as shown in FIG. 1. In these positions, the frames 25 resemble shelves, ready to receive and support the cargo.

Care is exercised, as in all proper packing procedures, to equalize the load on opposite sides of the animal. However, there is no requirement to form any type of sling using the pack lines to provide elevational support for the cargo. The cargo is instead supported on the support arm frames 25. Lashing is used primarily to secure the load against the pack frame.

Next, a central piece of cargo (not shown) can be placed on the animal between the two cargo loads already placed on the support arm frames 25. This step may also be completed after securing the load on the pack frame by appropriately binding the load on the frame with one or more pack lines.

It is emphasized at this point that the nature of the cargo may vary substantially. The present pack frame does not restrict the size or shape of the load, as do present forms of rigid or flexible "saddle bag" type packs. For example hay bales can be carried as easily as fence posts. This is due to the open configuration of the pack frame. It is important only that the load be balanced on the frame, and on opposite sides of the pack animal.

The pack lines are attached to the "D" rings 14, draped over the cargo, and lashed to the pack line catches 31. The cargo is now captured between the pack lines and the present base and support arm frames 15, 25, and the lines can be cinched tight and tied. The method of cinching and securing the pack lines may vary with the nature of the load. However it is noted that connection of the lines to the pack frame is greatly facilitated by provision of the pack line catches 31 in their exposed downwardly projecting positions clear of the load.

The cargo is now secured and supported on the animal by way of the present pack frame 10. Weight of the cargo is transmitted to the animal through the rigid frame. The load will be carried and maintained in position by the frame so the packer will not need to constantly check and re-adjust the load position by rearranging and cinching the pack lines.

Once the cargo has been delivered to the desired location, unloading can safely be accomplished simply by releasing the pack lines and lifting the cargo from the pack frame 10. It is noted that this step may be accomplished safely since loosening of the pack lines does not automatically also loosen the load and allow it to drop to the ground. If the load is properly balanced, the present pack frame 10 will continue to support the load. The packer can then, when desired, lift the cargo from the pack frame without worrying about simultaneously loosening the pack lines.

Once unloaded, the pack frame may be removed from the animal along with the pack saddle. The support arm frames 25 can alternatively be folded up and out of the way to the inoperative positions adjacent the base frames (FIG. 6). Here the support arm frames 25 no longer project outwardly of the animal and allow the animal to move about freely and the packer to move freely about the animal. For continued use, the support arm frames 25 can easily be again be folded down to their operative positions.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A pack frame mountable to a pack saddle for a pack animal such as a mule, comprising:

a pair of base frames;

an upright frame member on each base frame extending between top and bottom ends;

surfaces on each upright frame member extending between the top and bottom ends:

at least one strap for connecting the base frames to the pack saddle;

a pair of support arm frames;

a hinge mounted between each support arm frame and base frame permitting the support arm frame to move between: (a) an operative position substantially normal to the upright frame member, (b) an inoperative position alongside the upright frame member; and stops on the upright frame members and support arm frames, positioned thereon outward of the surfaces on the upright frame member to engage as the support arm frames are positioned in the operative positions to prevent the support arm frames from moving beyond the operative positions.

2. The pack frame of claim 1, further comprising a pack line catch on each of the support arm frames.

3. The pack frame of claim 1, wherein each support arm frame includes a top pack engaging surface and an opposed surface, and further comprising a pack line catch comprised of a hook facing inwardly toward the base frame on the opposed surface of each support arm frame.

4. The pack frame of claim 1, wherein the top ends of the upright frame members include back strap receiving slots.

5. The pack frame of claim 1;

wherein the support arm frames each include two support arm members, and further comprising:

a support arm connector member affixed to and connecting the support arm members of each support arm frame.

6. The pack frame of claim 1, wherein each base frame includes two upright frame members;

wherein each support arm frame includes two support arm members, and further comprising:

an upright frame connector member affixed to and connecting the upright frame members of each base frame; and a support arm connector member affixed to and connecting the support arm members of each support arm frame.

7. The pack frame of claim 1, wherein each base frame includes two upright frame members;

wherein each support arm frame includes two support arm members, and further comprising:

an upright frame connector member affixed to and connecting the two upright frame members of each base frame;

a support arm connector member affixed to and connecting the support arm members of each support arm frame;

the upright frame members including top ends forming strap receiving slots; and wherein each support arm member includes a top pack engaging surface and an opposed surface, with a pack line catch thereon.

8. The pack frame of claim 1, wherein each base frame includes two upright frame members, and further comprising:

an upright frame connector member affixed to and connecting the upright frame members of each base frame;

wherein each support arm frame includes a pair of support arm members;

a support arm connector member affixed to and connecting the support arm members of each support arm frame;

wherein the base frame includes strap receiving slots formed therein; and wherein each support arm member includes a top pack engaging surface and an opposed surface with a pack line catch thereon.

9. The pack frame of claim 1, wherein the stops on the upright frame members and support arm frames are integral with the upright frame members and support arm frames; and a pack line catch on each of the support arm frames.

10. The pack frame of claim 1, wherein the stops on the upright frame members and support arm frames are integral with the upright frame members and support arm frames; and wherein each support arm frame includes a top pack engaging surface and an opposed surface, and further comprising a pack line catch on the opposed surface.

11. The pack frame of claim 1, wherein the stops on the upright frame members and support arm frames are integral with the upright frame members and support arm frames; and wherein each support arm frame includes a top pack engaging surface and an opposed surface;

a pack line catch on the opposed surface of each support arm frame; and wherein the base frames include strap receiving slots.

12. The pack frame of claim 1, wherein each base frame includes two upright frame members, and further comprising:

an upright frame connector member affixed to and connecting the upright frame members of each base frame;

wherein each support arm frame includes two support arm members;

a support arm member connector affixed to and connecting the support arm members of each base frame;

wherein the stops on the upright frame members and support arm frames are integral with the upright frame members and support arm frames;

wherein each support arm member includes a top pack engaging surface and an opposed surface;

a pack line catch on the opposed surface of each support arm member; and wherein the upright frame members include top ends with back strap receiving slots formed therein.

13. The pack frame of claim 1, wherein the base frames and support arm frames are formed of aluminum.

14. The pack frame of claim 1, wherein the hinges are comprised of interfitting hinge sections on the base frames and support arm frames; and hinge pins joining the interfitting hinge sections.

15. The pack frame of claim 1, wherein the hinges are comprised of interfitting hinge sections on the base frames and support arm frames;

wherein the stops on the upright frame members and support arm frames are integral with the upright frame members and support arm frames; and hinge pins joining the interfitting hinge sections.

16. The pack frame of claim 1, wherein the base frames and support arm frames are formed of aluminum; and wherein the hinges are comprised of first hinge sections integral with the base frames and second hinge sections integral with the support arm frames, interfitting with the first hinge sections; and hinge pins joining the interfitting first and second hinge sections.

17. The pack frame of claim 1 wherein the surface on each upright frame member extending between the top and bottom ends is arched and shaped to conform to the pack animal's rib cage;

wherein the hinges are comprised of first hinge sections integral with the base frames and second hinge sections integral with the support arm frames, interfitting with the first hinge sections.

18. The pack frame of claim 1 wherein each support arm frame includes a top pack engaging surface and an opposed surface; and wherein the hinges are comprised of first hinge sections integral with the base frames and second hinge sections integral with the support arm frames and located along the top pack engaging surfaces thereof.

19. The pack frame of claim 1 wherein each support arm frame includes a top pack engaging surface and an opposed surface;

wherein the hinges are comprised of first hinge sections integral with the base frames and second hinge sections integral with the support arm frames and located along the top pack engaging surfaces thereof; and a pack catch on the opposed surface.

20. A pack frame subassembly mountable to a pack saddle for a pack animal such as a mule, comprising:

a base frame;

an upright frame member on the base frame extending between top and bottom ends;

the upright frame member including a flange at the bottom end, extending outwardly therefrom;

a support arm frame; and an integral hinge on the support arm frame and the flange of the upright frame member permitting the support arm frame to move between: (a) an operative position substantially normal to the upright frame member, and (b) an inoperative position alongside the upright frame member; and means for connecting the base frame to the pack saddle.

* * * * *